United States Patent [19]

Rumiesz, Jr. et al.

[11] Patent Number: 4,972,644

[45] Date of Patent: Nov. 27, 1990

[54] METAL BUILDING INSULATION

[75] Inventors: Joseph Rumiesz, Jr., Aurora; Donald R. Steinle, Littleton, both of Colo.

[73] Assignee: Manville Corporation, Denver, Colo.

[21] Appl. No.: 367,087

[22] Filed: Jun. 16, 1989

Related U.S. Application Data

[63] Continuation of Ser. No. 245,107, Sep. 16, 1988, abandoned.

[51] Int. Cl.[5] ..... E04B 1/62

[52] U.S. Cl. ..... 52/406; 428/172; 428/192; 428/255

[58] Field of Search ..... 52/406, 404, 409; 428/126, 172, 192, 255

[56] References Cited

U.S. PATENT DOCUMENTS

| | | | |
|---|---|---|---|
| 2,128,549 | 8/1938 | Zier | 52/407 |
| 2,238,022 | 4/1941 | Johnson | 52/404 |
| 2,943,965 | 7/1960 | Strogre | 428/182 |
| 3,307,306 | 3/1967 | Oliver | 52/409 |
| 3,318,063 | 5/1967 | Stone | 52/404 |
| 3,979,537 | 9/1976 | Troyer . | |
| 4,151,692 | 5/1979 | Holcombe | 52/404 |
| 4,378,401 | 3/1983 | Wright | 52/309.17 |
| 4,625,486 | 12/1986 | Dickinson | 52/404 |
| 4,700,521 | 10/1987 | Cover | 52/406 |

*Primary Examiner*—John E. Murtagh

*Attorney, Agent, or Firm*—John D. Lister; Cornelius P. Quinn; Fred A. Winans

[57] ABSTRACT

Metal building insulation comprising a low density glass fiber layer and a vapor retarding facing. The facing extends beyond one edge of the fibrous layer to form a tab, and comprises a laminate of a glass fiber mat bonded to the lower surface of the insulation layer, an intermediate glass fiber scrim and an outer vapor retarding sheet. The low density insulation is cost effective and easy to handle, the mat provides body to allow the tab to maintain contact with the facing of an adjacent insulation layer so as to form a vapor barrier across the butt joint between the adjacent layers, and the scrim provides tear strength.

4 Claims, 2 Drawing Sheets

METAL BUILDING INSULATION

This is a continuation of application Ser. No. 07/245,107, filed 9/16/89 now abandoned.

FIELD OF THE INVENTION

This invention relates to insulating material. More particularly, it relates to insulating material especially adapted for use in insulating metal buildings.

BACKGROUND OF THE INVENTION

Metal buildings are commonly employed as an economical utilitarian structure. In most cases they are insulated against heat or cold through the use of fibrous insulation which in the case of roof insulation usually takes the form of fiber glass blankets supported on spaced purlins. The interior face of the insulation, which is exposed to view, is comprised of a vapor retarding material capable of functioning as a vapor barrier. Because the insulation can be seen it is important that it not present an unsightly appearance.

Metal building roof insulation previously available has included relatively low density fibrous material having little rigidity and relatively high density fibrous material having substantial rigidity. The low density material, which tends to sag unless supported on closely spaced centers, is often provided with a vapor retardant facing that extends beyond both longitudinal edges of the insulation for a distance of about 3". During installation these tabs are folded up and stapled to the folded tabs of the next adjacent row of insulation to provide a continuous vapor barrier. This arrangement is more labor intensive than desired and is less pleasing in appearance than desired.

Another previously available low density product incorporates only a single tab extending about 6" from one of the longitudinal edges of the insulation. When installed the edges of the insulation are butted and the tabs extend over the joints between adjacent insulation lengths. To provide an effective vapor barrier, however, it is necessary to glue the tabs to the underside of the adjacent lengths of insulation. Thus the installation time is slowed due to this operation.

A relatively high density metal building roof insulation product previously available also incorporated a facing having a single tab extending from one of the longitudinal edges of the insulation. The tab was reinforced by a portion of the facing sheet being folded upon itself or by a supplemental tape, and was thus able to remain in contact with the facing of the adjacent length of insulation without gluing or stapling. As a result, the installation of the material was faster than the installation of the low density product. The overall cost of the high density product was more than desired, however, because of the greater cost of the high density material.

In view of the drawbacks of the existing metal building insulation systems, it would be desirable to have available a low density metal building insulation which can be installed without having to glue or staple the facing tabs during installation. This would reduce the cost of the installation by allowing use of relatively inexpensive insulation without requiring the labor intensive installation practices of the prior art.

SUMMARY OF THE INVENTION

The metal building insulation of the invention comprises a layer of relatively low density fibrous insulation having opposite longitudinal edges. Adhered to one surface of the insulation and extending beyond one edge of the insulation in the form of a tab is a flexible facing layer comprising a laminate having an outer vapor retardant sheet and a thin fibrous mat. In a preferred embodiment the laminate also includes a fibrous scrim sandwiched between the vapor retardant sheet and the fibrous mat. Although the fibrous mat is thin and by structural standards possesses little strength or rigidity, it nevertheless provides the unsupported tab with enough rigidity to remain in contact with the overlapped face of an adjacent length of insulation without the need to separately attach it as by staples or adhesive. This allows the vapor retardant sheets of adjacent lengths of insulation to function as a continuous vapor barrier and permits the roof insulation to be quickly installed.

Preferably the insulation is comprised of a bonded fiber glass layer having a density in the range of 0.4–0.6 pcf, and the mat is comprised cf bonded fiber glass having a density in the range of 0.8–1.1 pcf. Through the use of low density fibrous materials the amount of fiber in the product is minimized, which results in low cost fibrous components and an overall economical insulation product.

Other features and aspects of the invention, as well as other benefits of the invention, will readily be ascertained from the more detailed description of the invention which follows.

DESCRIPTION OF THE PREFERRED EMBODIMENT

Figure 1:
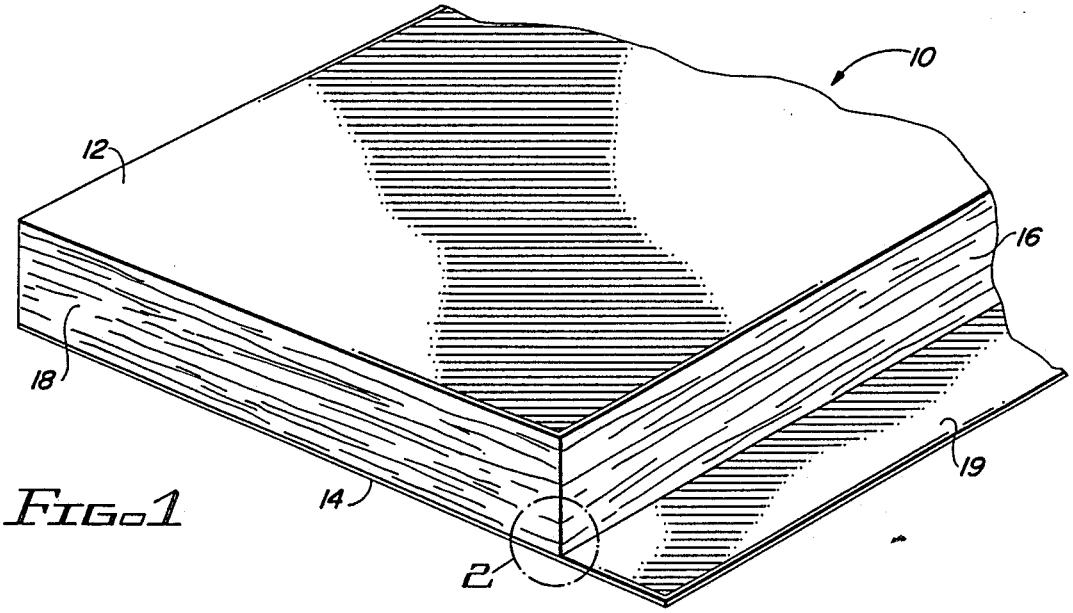
FIG. 1 is a partial pictorial view of the metal building insulation of the present invention.

Referring to FIG. 1, the insulation product 10 of the present invention comprises a layer of fibrous insulation 12 and a facing sheet 14 adhered to the lower or interior surface of the insulation layer. The layer of insulation is elongated, having relatively long longitudinal edges 16 and relatively short transverse edges 18. The facing sheet 14 covers the entire lower surface of the insulation layer and extends beyond one of the longitudinal edges 16 to form a continuous tab 19. The layer of insulation preferably comprises conventional bonded glass fiber of low density, in the range of 0.4–0.6 pcf, conforming to the standards of fiber glass insulation for use in metal buildings set forth in the Thermal Insulation Manufacturers Association bulletin entitled "TIMA Standard 202". The facing sheet 14 comprises a laminate shown in more detail in FIG. 2.

Figure 2:
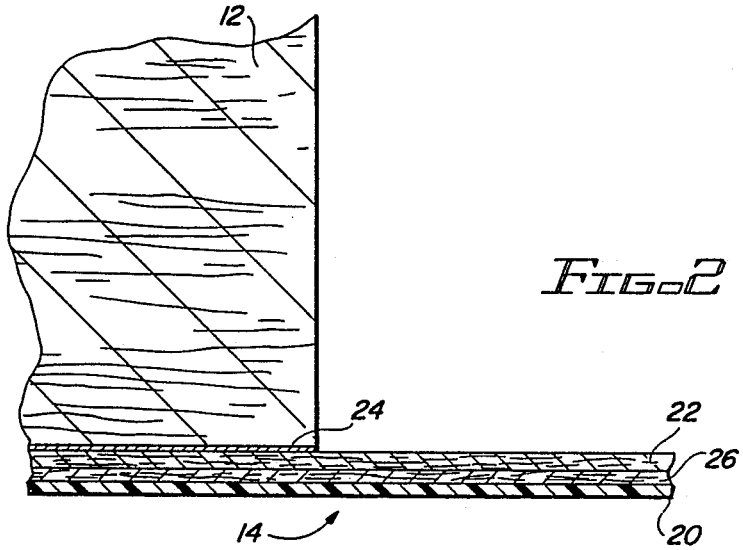
FIG. 2 is an enlarged partial transverse sectional view of the facing laminate shown adhered to the underside of a layer of fibrous insulation.

As illustrated in FIG. 2, the laminate 14 comprises an outer vapor retardant sheet 20, a fibrous mat 22 adhered to the lower surface of the insulation layer 12 by a coating of adhesive 24, and a fibrous scrim 26 sandwiched between the sheet 20 and the mat 22. The sheet 20 is a flexible sheet comprised of any suitable vapor retardant material, such as, for example, polyester or polypropylene. Because the sheet 20 is not relied upon to supply strength to the product it may be as thin as is practicable for withstanding the stresses of handling, resisting puncturing and providing an adequate vapor barrier. A thickness in the order of 1.4 mils has been found to perform satisfactorily.

The mat 22 is fibrous in nature and, although it may be comprised of any fibrous material capable of supplying the necessary strength and rigidity to the product, the preferred material is a conventional bonded glass fiber mat having a density in the range of 0.8–1.1 pcf and a thickness in the range of 10–20 mils. The mat 22, and hence the laminate 14 as well, is bonded to the underside of the fibrous layer 12 by a layer or coating of adhesive 24. Any of the many suitable adhesives commonly employed to bond facing materials to a layer of bonded glass fiber insulation may be used. Although such a mat in the lengths employed is not by itself considered to be rigid, and in fact is a flexible material, it nevertheless possesses enough rigidity or stiffness in combination with the resiliency or memory of the fibers comprising it, to enable the tab 19 to remain in contact with the underside of the next adjacent length of faced insulation. This ability is the reason the tab is able, in conjunction with the overlapped facing of the adjacent length of insulation, to provide a continuous vapor barrier without being mechanically connected to the adjacent length by staples or glue.

Figure 3:
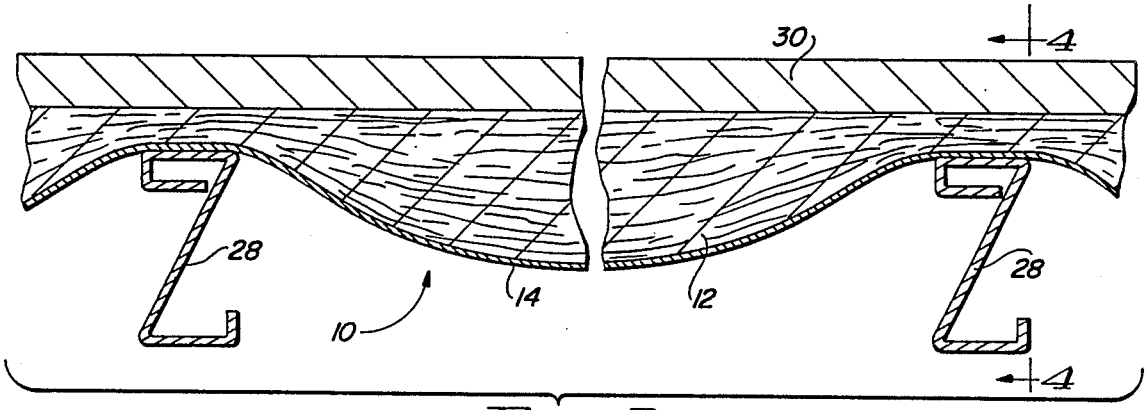
FIG. 3 is an enlarged partial longitudinal sectional view of an installed length of metal building insulation showing the insulation supported on transversely extending purlins.
Figure 4:
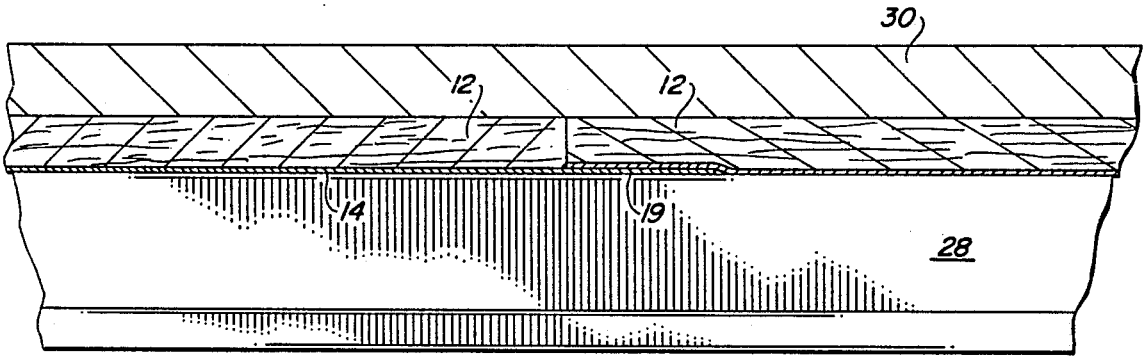
FIG. 4 is an enlarged partial transverse sectional view of an installed length of metal building insulation, taken along line 4—4 of FIG. 3, showing the metal building insulation in place between a purlin roof of the building.

Still referring to FIG. 2, the fibrous scrim 26 sandwiched between the sheet 20 and the mat 22 is preferably a conventional fiber glass scrim but may be comprised of any suitable fibrous material capable of providing the laminate with tear strength. Since the outer plastic sheet 20 performs only a moisture-proofing function and does not contribute to the strength of the laminate, and since a fibrous mat 22 of the type described above does not normally possess adequate tear strength, the tear resistance provided by the scrim is necessary to the performance of the insulation product. It is possible to employ a vapor retardant laminate which does not include a scrim, but the fibrous mat in such an arrangement would then have to incorporate reinforcing strands to provide the necessary tear resistance. The reinforcing strands may be spaced apart a distance similar to the spacing between strands in a scrim, and should extend both longitudinally and transversely of the insulation length in order to provide tear resistance in all directions. The laminate preferably is formed in a separate laminating operation and supplied in roll form to the insulation producing operation, where it can be adhered to the insulation by well known conventional means. The faced insulation preferably is supplied in roll form and is installed by unrolling it over the purlins of a metal building under construction. As shown in FIGS. 3 and 4, strips of faced insulation 12 are supported along their length by spaced purlins 28. The adjacent side edges of adjacent insulation lengths have been abutted, and the tab portion 19 of each facing 14 overlaps the facing of the adjacent insulation length to seal the joint between the lengths against the entry of moisture, thus creating a continuous vapor barrier across the interior surface of the lengths of roof insulation.

In the construction of a metal building, after the roof insulation has been installed over the purlins the metal roof is attached to the building structure. As illustrated in FIGS. 3 and 4, the roof 30 is normally so closely spaced to the purlins 28 that it contacts the upper surface of the insulation 12. In practice, the insulation is effectively clamped between the roof and the purlins, compressing the insulation from an original thickness of perhaps 4" to a thickness of about ½–1". The insulation between purlins normally remains in contact with the underside of the roof, exhibiting a pillowing effect, whereby the insulation midway between the purlins may be at its original uncompressed thickness but whereby the insulation has not sagged away from the roof. Due to the physical attributes of the facing laminate 14 described above, the tab 19 does not droop out of contact with the facing of the next adjacent length of insulation between purlins but is urged against the facing to maintain a vapor barrier along the joint between insulation lengths. Such contact can readily be maintained between the normal 5 foot spacing between purlins and in fact can be maintained over substantially greater spans if required.

Figure 5:
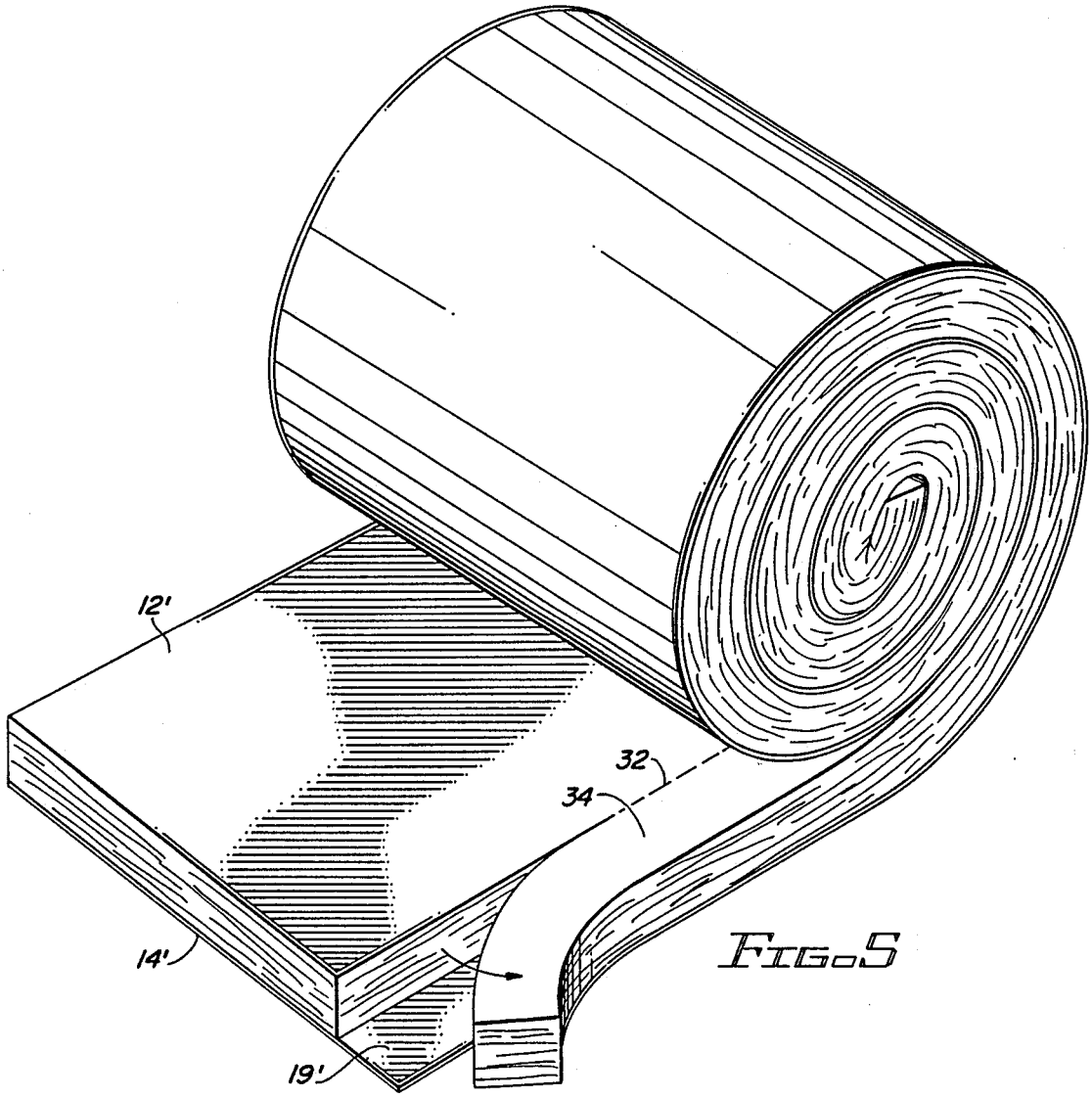
FIG. 5 pictorial view similar to that of FIG. 1, but showing a modification thereof.

As shown in FIG. 5, in a modified version of the invention the insulation layer 12' may be slit, as at 32, a distance from the nearest side edge corresponding to the width of the tab 19'. The elongated strip of insulation 34 between the slit 32 and the edge of the insulation length would be left intact during shipping in order to protect the tab 19' and would be removed as indicated in the drawing prior to installation.

Due to the nature of the components of the laminated metal building roof insulation product of the invention it is capable of qualifying for an Underwriters Laboratory rating of 25/50 for tests measuring the rate of flame spread and amount of smoke developed.

It will now be appreciated that the invention provides an economical metal building insulation which is simple to install and which provides an effective vapor barrier across the entire interior surface of the installed insulation. Because the tabs of the facing laminate overlap the next length of insulation and maintain flush contact against the surface without the need for separate fastening means, there are no unsightly folded tab portions or staples. As a result of not having to staple or glue the tabs, the installation proceeds substantially faster than with other metal building insulation systems.

It should now be understood that the invention is not necessarily limited to all the specific details of the preferred embodiment, but that changes to certain features of the preferred embodiment which do not affect the overall basic function and concept of the invention may be made by those skilled in the art without departing from the spirit and scope of the invention, as defined in the appended claims.

What is claimed is:

1. An insulation blanket comprising:

a first relatively thick fibrous mat of bonded glass fibers having a first density for providing a layer of insulation, defining upper and lower faces and opposite longitudinal edges;

a relatively thin flexible facing material comprising a laminate formed of adhered layers of at least:

a flexible outer vapor-retarding sheet;

and, a second fibrous mat of randomly dispersed, irregularly oriented, bonded glass fibers having a second density providing, in said adhered condition, relative structural rigidity to said flexible facing, said second density being greater than said first density, and wherein said second fibrous mat of bonded glass fibers is adhered to the lower face of said first fibrous mat to form said blanket and, wherein said flexible facing laminate covers the entire lower face of said first fibrous mat and extends outboard beyond at least one longitudinal edge of said first fibrous mat a predetermined distance to define a tab portion of said flexible facing laminate; and said relatively thin facing laminate has a generally constant thickness throughout, including said tab portion.

2. An insulation blanket according to claim 1 wherein said first fibrous mat has a density of less than 0.6 pcf and the second fibrous mat has a density of greater than 0.8 pcf.

3. Structure according to claim 1 wherein the tab portion of the flexible facing laminate extends at least three inches beyond the adjacent longitudinal edge of the first fibrous mat.

4. An insulation blanket according to the claim 1 wherein the flexible facing laminate further includes a fibrous scrim layer between the vapor retarding outer sheet and the second fibrous mat of bonded glass fibers, said scrim being comprised of glass fibers.

* * * * *